US008286711B2

(12) United States Patent
Neto et al.

(10) Patent No.: US 8,286,711 B2
(45) Date of Patent: Oct. 16, 2012

(54) RUNNING TOOL THAT PREVENTS SEAL TEST

(75) Inventors: Guilherme Pedro Eppinghaus Neto, Rio de Janeiro (BR); Francisco Kobata, Sao Paulo (BR); Nicholas P. Gette, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 529 days.

(21) Appl. No.: 12/490,874

(22) Filed: Jun. 24, 2009

(65) Prior Publication Data

US 2010/0326664 A1 Dec. 30, 2010

(51) Int. Cl.

| | |
|---|---|
| ***E21B 33/043*** | (2006.01) |
| ***E21B 33/04*** | (2006.01) |
| ***E21B 43/10*** | (2006.01) |
| ***E21B 23/06*** | (2006.01) |

(52) U.S. Cl. ..... 166/336; 166/123; 166/348

(58) Field of Classification Search ..... 166/336, 166/341, 343, 348, 123, 182, 209
See application file for complete search history.

(56) References Cited

U.S. PATENT DOCUMENTS

| | | | | |
|---|---|---|---|---|
| 4,712,621 | A * | 12/1987 | Wightman et al. | 166/382 |
| 4,969,516 | A * | 11/1990 | Henderson et al. | 166/182 |
| 4,969,517 | A * | 11/1990 | Valka et al. | 166/208 |
| 5,105,888 | A * | 4/1992 | Pollock et al. | 166/348 |
| 6,516,876 | B1 | 2/2003 | Jennings | |
| 6,719,044 | B2 | 4/2004 | Ford et al. | |
| 6,823,938 | B1 * | 11/2004 | Milberger | 166/209 |
| 6,848,511 | B1 | 2/2005 | Jones et al. | |
| 7,231,970 | B2 | 6/2007 | Matusek et al. | |
| 7,407,011 | B2 | 8/2008 | Kent | |
| 7,909,107 | B2 * | 3/2011 | Gette | 166/382 |

* cited by examiner

*Primary Examiner* — Thomas Beach
*Assistant Examiner* — James Sayre
(74) *Attorney, Agent, or Firm* — Bracewell & Giuliani LLP

(57) ABSTRACT

A running tool sets a casing hanger packoff and ensures that the packoff is not pressure tested unless the proper setting stroke was made by the running tool. The running tool has a stem, an inner body, and a piston. The inner body is connected to the stem so that rotation of the stem relative to the inner body will cause the stem to move longitudinally. The piston is connected to the stem so that the stem and piston rotate and move longitudinally in unison. A test slot is located in the outer surface of the inner body. A limit pin is connected to the piston and is adapted to engage the test slot when the piston moves longitudinally relative to the inner body. The stem has a raised profile on a portion of its exterior surface.

18 Claims, 9 Drawing Sheets

35
33
31
85
37
83
45
39
95
49
89
97
43
81
75
105
71
101
51
103
63
67
47
65
57
61
59
107
55
41
53

31
33
83
37
49
43
39
89
97
105
111
65
57
57
61
59
107
53

RUNNING TOOL THAT PREVENTS SEAL TEST

FIELD OF THE INVENTION

This technique relates in general to tools for running casing hangers and in subsea wells, and in particular to a running tool that prevents a seal test when the seal is not properly set.

BACKGROUND OF THE INVENTION

A subsea well of the type concerned herein will have a wellhead supported on the subsea floor. One or more strings of casing will be lowered into the wellhead from the surface, each supported on a casing hanger. The casing hanger is a tubular member that is secured to the threaded upper end of the string of casing. The casing hanger lands on a landing shoulder in the wellhead, or on a previously installed casing hanger having larger diameter casing. Cement is pumped down the string of casing to flow back up the annulus around the string of casing. Afterward, a packoff is positioned between the wellhead bore and an upper portion of the casing hanger. This seals the casing hanger annulus.

Casing hanger running tools perform many functions such as running and landing casing strings, cementing strings into place, and installing and testing packoffs. Once a packoff is set, it is often tested by applying fluid pressure to an upper side of the packoff. If the packoff has not been properly set, fluid pressure may leak past the annulus packoff, causing the casing to collapse.

A need exists for a technique that ensures that the packoff is pressure tested only when it has been properly set. The following technique may solve one or more of these problems.

SUMMARY OF THE INVENTION

In an embodiment of the present technique, a running tool sets a casing hanger packoff and allows the packoff to be tested, but only if the packoff has been properly set. The running tool is comprised of an inner body, a piston, and a stem. The inner body substantially surrounds and is connected to the stem of the running tool so that rotation of the stem relative to the inner body will cause the stem to move longitudinally. The piston substantially surrounds the inner body and the stem and is connected to the stem so that the piston and the stem rotate and move longitudinally in unison.

A port extends through the inner body from an exterior surface thereof and passes into a chamber defined by the area between the stem, the piston, and the inner body. The stem has a raised profile on a portion of its outer surface. The inner body has a seal positioned on its interior surface that seals against the raised surface portion of the stem when the packoff is properly set and the packoff is tested, thereby prohibiting fluid pressure from passing from the chamber and into the passage between the inner body and the stem. A test slot is located in and extends through the exterior surface of the inner body.

An inwardly biased limit pin is carried by the piston and is adapted to fully engage the test slot when the packoff is properly set. Downward longitudinal movement of the stem and piston relative to the inner body sufficient to properly set the packoff allows the limit pin to fully engage the test slot and reach a set position. Downward longitudinal movement of the stem and piston relative to the inner body insufficient to properly set the packoff allows the limit pin to only partially engage the test slot and reach a safe position.

When the packoff is to be tested, the stem and piston move longitudinally upward relative to the inner body. If the limit pin has fully engaged the slot, the limit pin will move from the set position to a test position whereby the seal on the inner surface of the inner body seals against the raised profile portion of the stem, allowing fluid pressure to reach the packoff, thereby testing it. If the limit pin has only partially engaged the slot, the limit pin will maintain the safe position whereby the seal on the inner surface of the inner body will not seal against the raised profile portion of the stem, allowing fluid pressure to pass through the port, into the chamber, and through the passage between the stem and the inner body before flowing back up the string of drill pipe.

DETAILED DESCRIPTION OF THE INVENTION

Figure 1:
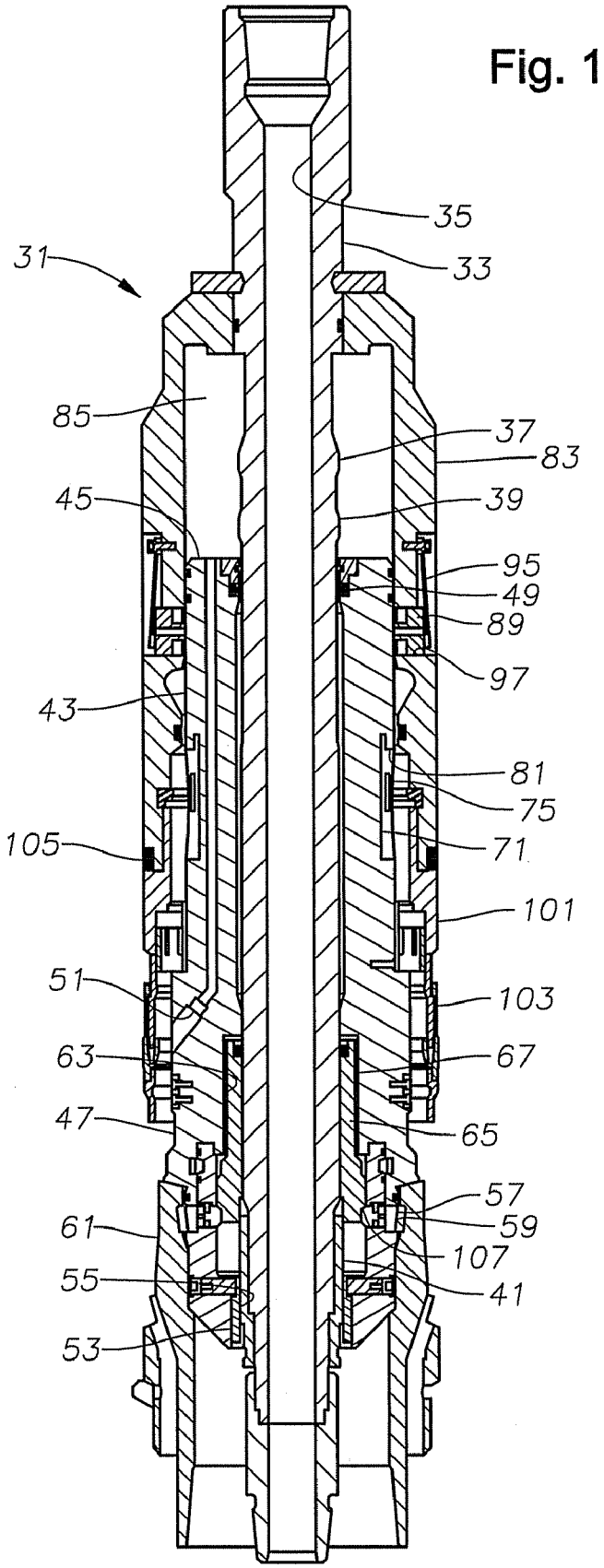
FIG. 1 is a sectional view of a running tool constructed in accordance with the present technique with the piston cocked and the engagement element retracted.

Referring to FIG. 1, there is generally shown an embodiment for a running tool 31 that is used to set and test a casing hanger packoff. The running tool 31 is comprised of a stem 33. Stem 33 is a tubular member with an axial passage 35 extending therethrough. Stem 33 connects on its upper end to a string of drill pipe (not shown). Stem 33 has a first raised profile 37 on its outer surface. A second raised profile 39 is positioned on the outer surface of stem 33, an increment below the first raised profile 37. The portions of stem 33 where first raised profiles 37, 39 are positioned have a greater diameter than the portions of the stem 33 positioned above and below the profiles 37, 39. A lower portion of the stem 33 has threads 41 in its outer surface.

Running tool 31 has an inner body 43 that surrounds stem 33, as stem 33 extends axially through the inner body 43. Inner body 43 has an upper body portion 45 and a lower body portion 47. A seal 49 is positioned between the inner surface of the upper body portion 45 of inner body 43 and stem 33. Seal 49 acts to seal between the inner body 43 and the stem 33 when the seal 49 is engaged with either of the raised profiles 37, 39 on the outer surface of stem 33. Inner body 43 has a fluid port 51 positioned in and extending diagonally inward from its exterior surface near lower body portion 47. Fluid port 51 then extends axially upward from the lower body portion 47 through the upper body portion 45 of inner body 43. Fluid port 51 allows fluid communication between the exterior and interior of the inner body 43 when the seal 49 is not engaged with raised profiles 37, 39 on stem 33.

The lower body portion 47 of inner body 43 is connected to a bearing cap 53. The bearing cap 53 has threads 55 along its inner surface that are engaged with threads 41 on the outer surface of stem 33. The lower portion 47 of inner body 43 and bearing cap 53 house an engaging element 57. In this particular embodiment, engaging element 57 is a set of dogs having a smooth inner surface and a contoured outer surface. The contoured outer surface is adapted to engage a complimentary contoured surface 59 on the inner surface of a casing hanger 61 when the engagement element 57 is engaged with the casing hanger 61. Although not shown, a string of casing is attached to the lower end of casing hanger 61.

The lower body portion 47 of inner body 43 has an inner recess with threads 63 along its inner surface. A cam 65 is positioned between the stem 33 and the inner recess of inner body 43. Cam 65 has threads 67 on its outer surface that are in engagement with the threads 63 on the surface of the inner recess of lower body portion 47 of inner body 43. Cam 65 and stem 33 are connected to one another such that cam 65 and stem 33 rotate in unison, but cam 65 may move axially relative to inner body 43, independent from stem 33. For example, cam 65 and stem 33 may be connected to one another by means of anti-rotation keys.

A test slot 71 is located in and extends radially inward through the exterior surface of the inner body 43. A restrictor 75 divides slot 71 into an inner pocket portion and an outer pocket portion, forming a downward facing shoulder 81 between the two. The diameter of slot 71 is greater below the restrictor 75 than above.

An outer body or piston 83 surrounds stem 33 and substantial portions of the inner body 43. Piston 83 is connected to stem 33 such that the two rotate and move in unison. A piston chamber 85 is formed between an upper surface of upper body portion 45 of inner body 43, inner surface portions of piston 83, and outer surface portions of stem 33. Piston 83 is initially in an upper position relative to inner body 43, meaning that the area of piston chamber 85 is at its largest possible value, allowing for piston 83 to be driven downward.

A limit pin 89 is connected to the outer surface of the outer body or piston 83. Limit pin 89 is connected to piston 83 by way of an inwardly biased spring 95 that forces limit pin 89 inwards. Limit pin 89 rides in an aperture 97 located in and extending through piston 83. Limit pin 89 is initially in contact with the outer surface of inner body 43. Limit pin 89 is adapted to engage test slot 71 and enter into the lower portion of the slot 71 with the larger diameter when the piston 83 moves axially relative to the inner body a desired distance.

A setting sleeve 101 is connected to the lower end of piston 83. Setting sleeve 101 carries a packoff seal 103 which is positioned along the lower end portion of setting sleeve 101. Packoff seal 103 will act to seal the casing hanger 61 to a high pressure housing when properly set. While piston 83 is in the upper position, packoff seal 103 is spaced above casing hanger 61.

An elastomeric seal 105 is located on the outer surface of the running tool 31 between piston 83 and setting sleeve 101 and expands radially when weight is applied downward on it, thereby sealing between the running tool 31 and a high pressure housing.

Referring to FIG. 1, in operation, the running tool 31 is initially positioned such that it extends axially through a casing hanger 61. The piston 83 is in an upper position, and the raised profiles 37, 39 on stem 33 are not in contact with the seal 49 on the inner surface of inner body 43. Casing hanger packoff seal 103 is carried by setting sleeve 101 which is connected to piston 83. The running tool 31 is lowered into the casing hanger 61 until the outer surface of inner body 43 and bearing cap 53 of running tool 31 slidingly engage the inner surface of casing hanger 61.

Figure 2:
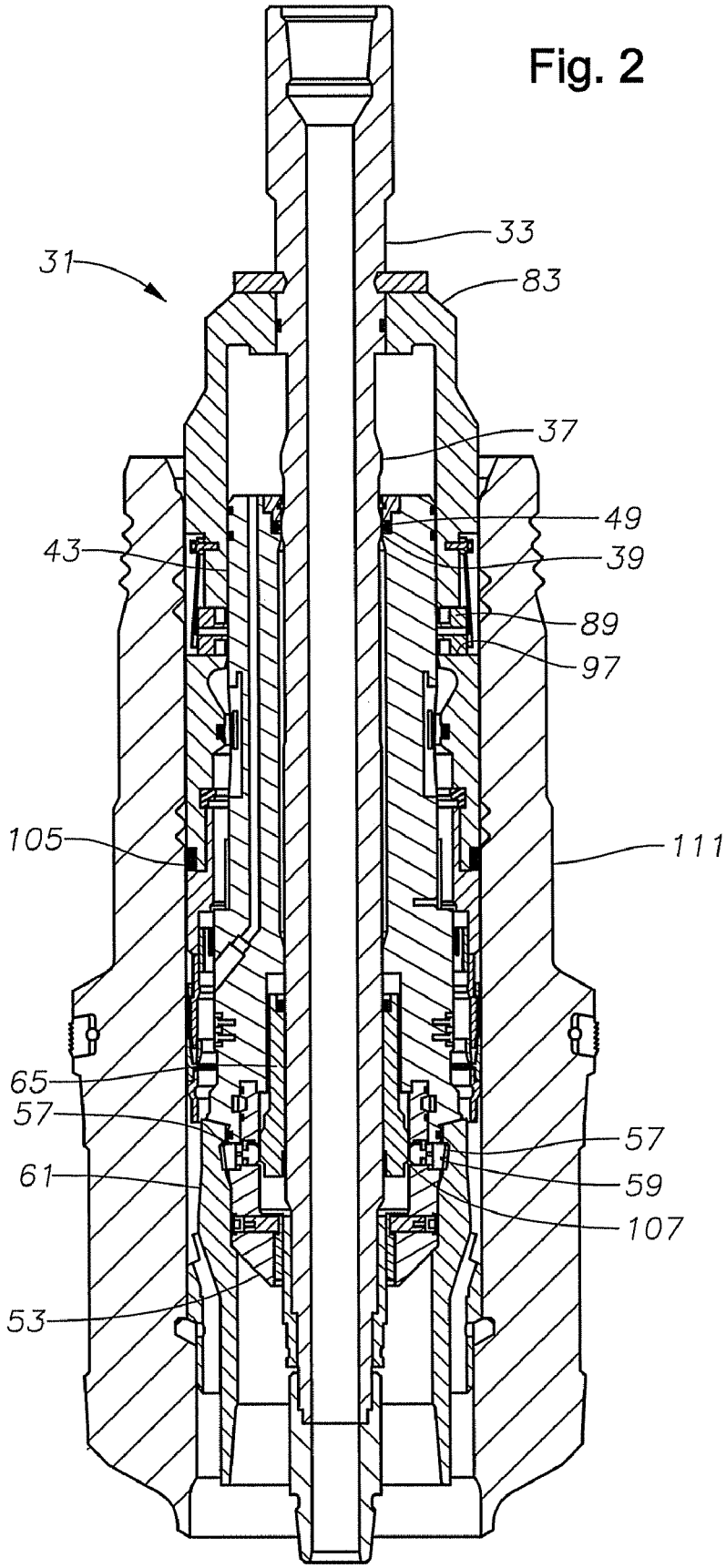
FIG. 2 is a sectional view of the running tool of FIG. 1 in the running position with the engagement element engaged.

Referring to FIG. 2, once running tool 31 and casing hanger 61 are in abutting contact with one another, the stem 33 is rotated four revolutions. As stem 33 rotates, a portion of it unthreads from bearing cap 53 and stem 33 and piston 83 move longitudinally downward relative to inner body 43. As the stem 33 and piston 83 move longitudinally downward relative to inner body 43, the limit pin 89 captured in aperture 97 on piston 83 also moves longitudinally downward relative to inner body 43. As the stem 33 is rotated relative to the inner body 43, cam 65 rotates in unison and simultaneously unthreads from inner body 43 and moves longitudinally downward relative to inner body 43. A shoulder 107 on the outer surface of the cam 65 makes contact with the engaging element 57, forcing it radially outward and in engaging contact with profile 59 on the inner surface of casing hanger 61, thereby locking inner body 43 to casing hanger 61. As the stem 33 moves longitudinally, the seal 49 on the inner surface of inner body 43 and raised profiles 37, 39 on the outer surface of stem 33 also move relative to one another. Once the running tool 31 and casing hanger 61 are locked to one another, the running tool 31 and casing hanger 61 are lowered down the riser into a high pressure housing 111 until the casing hanger 61 comes to rest.

Figure 3:
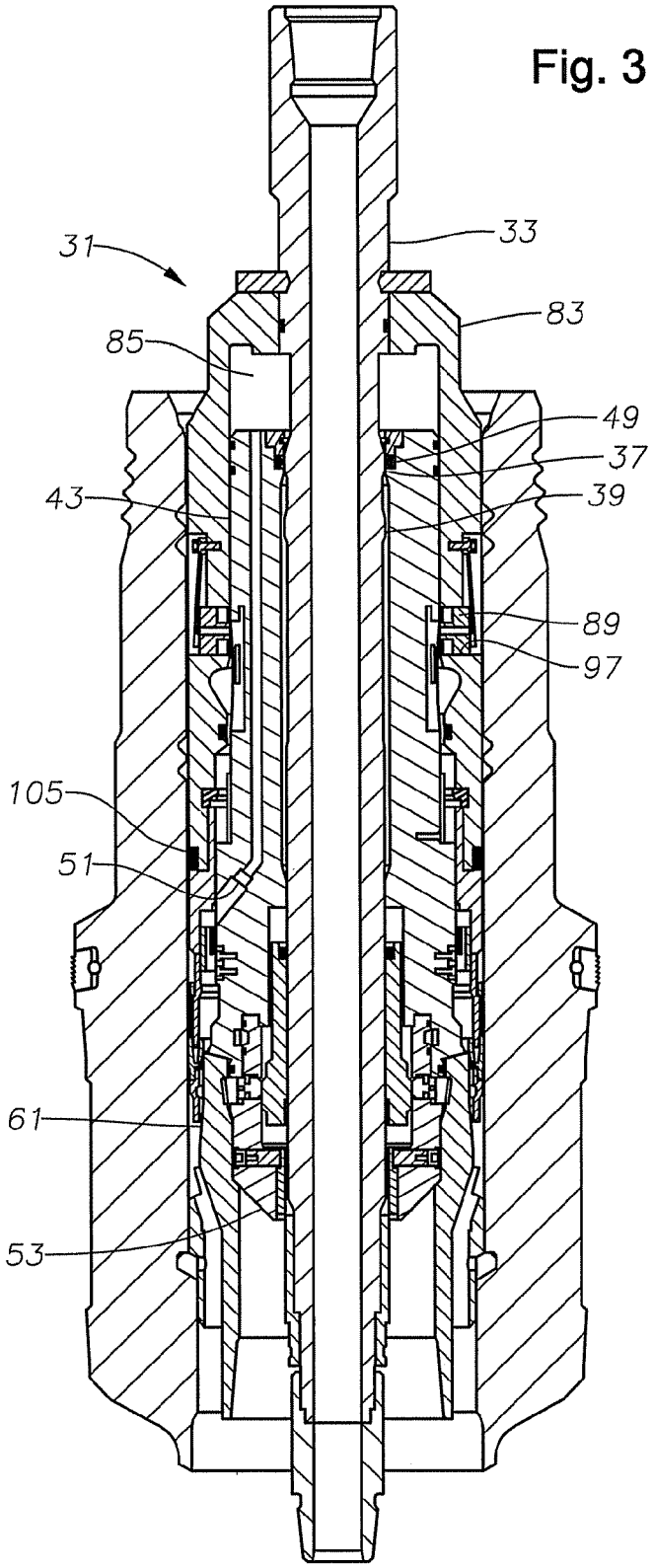
FIG. 3 is a sectional view of the running tool of FIG. 1 with the piston and stem released from the inner body.
Figure 4:
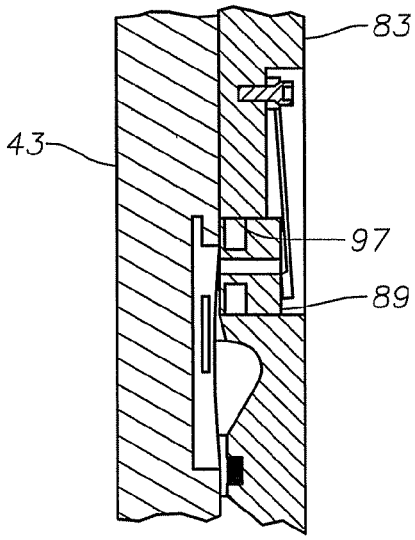
FIG. 4 is an enlarged view of the limit pin and test slot portions of the running tool of FIG. 3.
Figure 5:
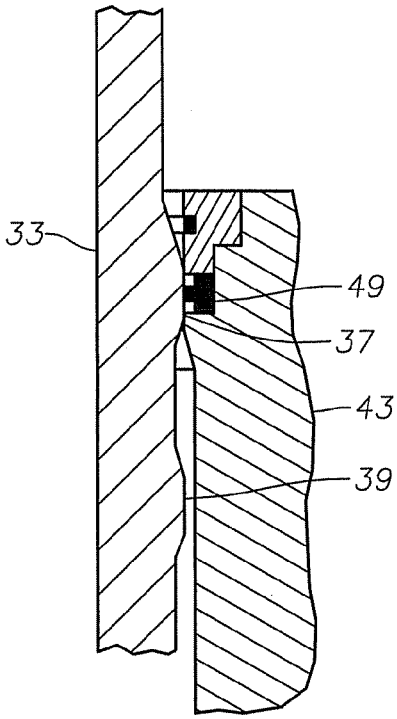
FIG. 5 is an enlarged view of the stem and inner body seal portions of the running tool of FIG. 3.

Referring to FIG. 3, stem 33 is then rotated four additional revolutions in the same direction. As the stem 33 is rotated relative to the inner body 43, the stem 33 completely unthreads from bearing cap 53, freeing stem 33 and piston 83 to move further longitudinally downward relative to inner body.43 and casing hanger 61. As the stem 33 and piston 83 move further longitudinally downward relative to inner body 43, the limit pin 89 captured in aperture 97 on piston 83 also moves further longitudinally downward relative to inner body 43 (FIG. 4). As the stem 33 moves further longitudinally downward, the seal 49 on the inner surface of inner body 43 and raised profiles 37, 39 on the outer surface of stem 33 also move relative to one another. Seal 49 engages the first raised profile 37 on the outer surface of stem 33 (FIG. 5).

Figure 6:
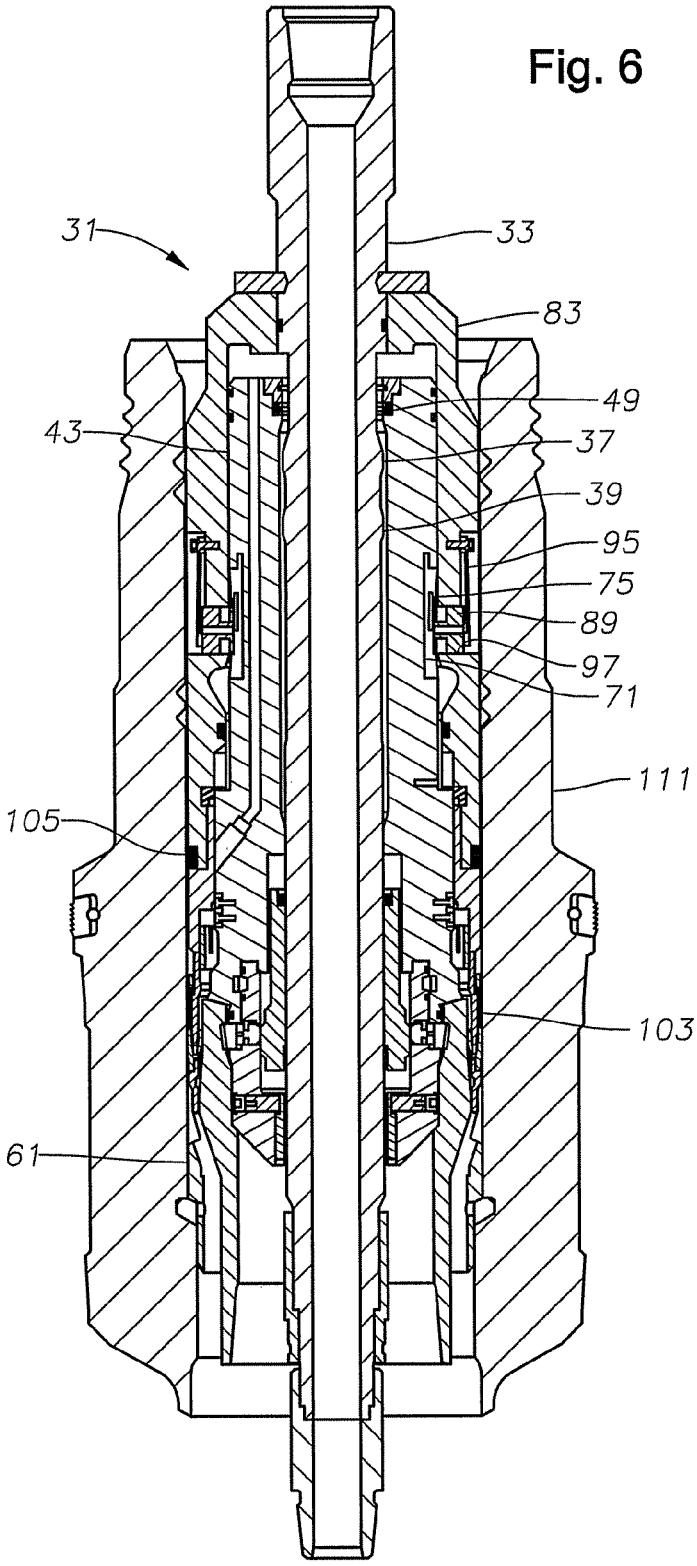
FIG. 6 is a sectional view of the running tool of FIG. 1 in the landing position.

Referring to FIG. 6, weight is then applied downward on the string of drill pipe (not shown) and subsequently to the stem 33 and piston 83. As stem 33 and piston 83 move further longitudinally downward relative to inner body 43, the packoff seal 103 lands between the casing hanger 61 and high pressure housing 111. As the weight is applied downward on elastomeric seal 105, seal 105 expands radially outward, sealing between running tool 31 and high pressure housing 111.

Figure 7:
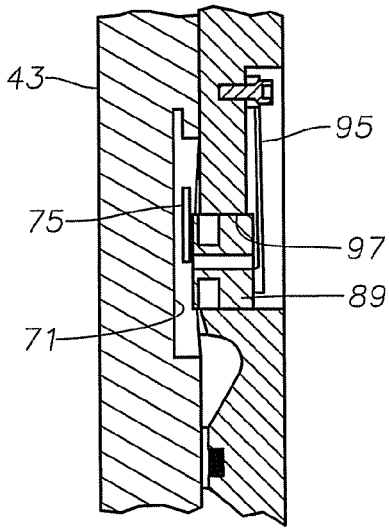
FIG. 7 is an enlarged view of the limit pin and test slot portions of the running tool of FIG. 6.
Figure 8:
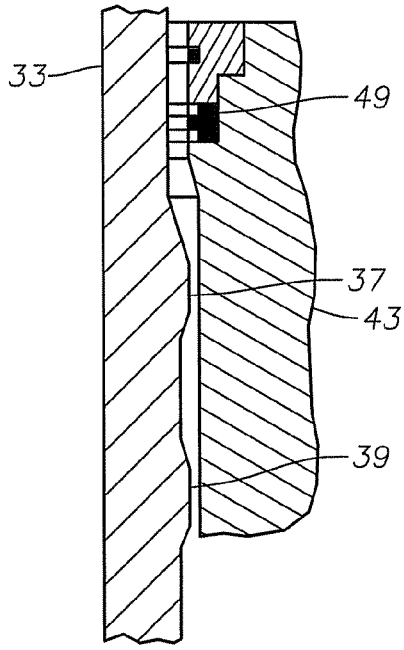
FIG. 8 is an enlarged view of the stem and inner body seal portions of the running tool of FIG. 6.

As the stem 33 and piston 83 move further longitudinally downward relative to inner body 43, the limit pin 89 captured in aperture 97 on piston 83 also moves further longitudinally downward relative to inner body 43. Limit pin 89 reaches test slot 71 and is forced radially inward by spring 95. Restrictor 75 prevents limit pin 89 from fully entering slot 71 (FIG. 7). As the stem 33 moves further longitudinally downward relative to inner body 43, the seal 49 on the inner surface of inner body 43 and raised profiles 37, 39 on the outer surface of stem 33 also move relative to one another. Seal 49 on the inner surface of inner body 43 disengages from first raised profile 37 on the outer surface of stem 33 (FIG. 8).

Figure 9:
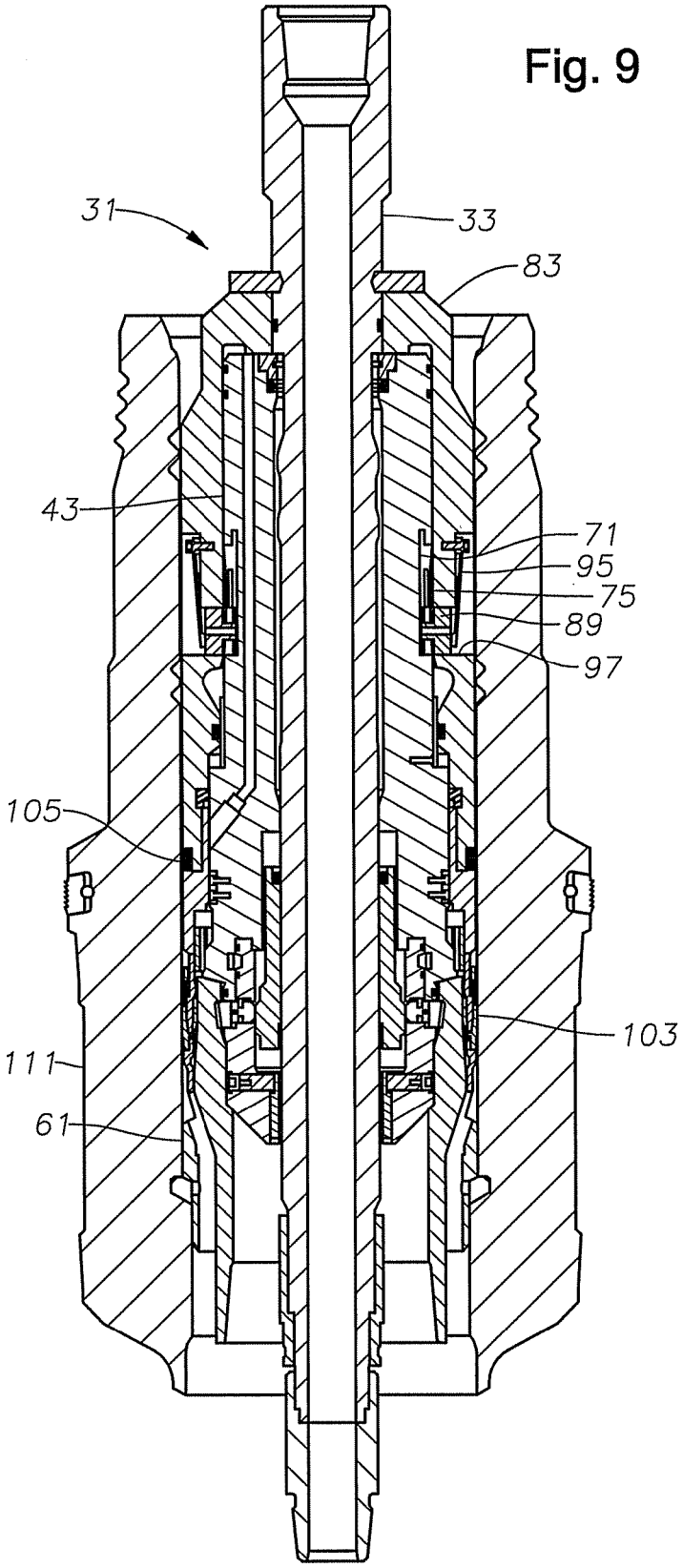
FIG. 9 is a sectional view of the running tool of FIG. 1 in the set position.
Figure 10:
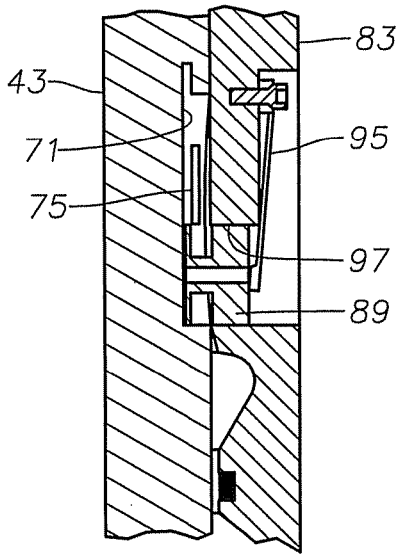
FIG. 10 is an enlarged view of the limit pin and test slot portions of the running tool of FIG. 9.

Referring to FIG. 9, drillpipe rams (not shown) or an annular blower preventer (not shown) are closed and fluid pressure is applied down the annulus. Elastomeric seal 105 seals between running tool 31 and high pressure housing 111, allowing the pressure above seal 105 to build until it forces stem 33 and piston 83 longitudinally downward relative to inner body 43. As the piston 83 moves downward, the movement of piston 83 sets the packoff seal 103 between an outer portion of casing hanger 61 and the inner diameter of the subsea wellhead housing 111. Piston 83 moves longitudinally downward relative to inner body 43 until piston chamber 85 (FIG. 1) is eliminated and piston 83 and inner body 43 are in contact with one another. As the stem 33 and piston 83 move further longitudinally downward relative to inner body 43, the limit pin 89 captured in aperture 97 on piston 83 also moves further longitudinally downward relative to inner body 43. When the piston 83 has moved longitudinally downward relative to the inner body sufficiently to set packoff seal 103, limit pin 89 reaches the lower portion of test slot 71 and is no longer restricted by restrictor 75. Limit pin 89 is forced further radially inward by spring 95, fully entering slot 71 and reaching a "set" position (FIG. 10).

Figure 11:
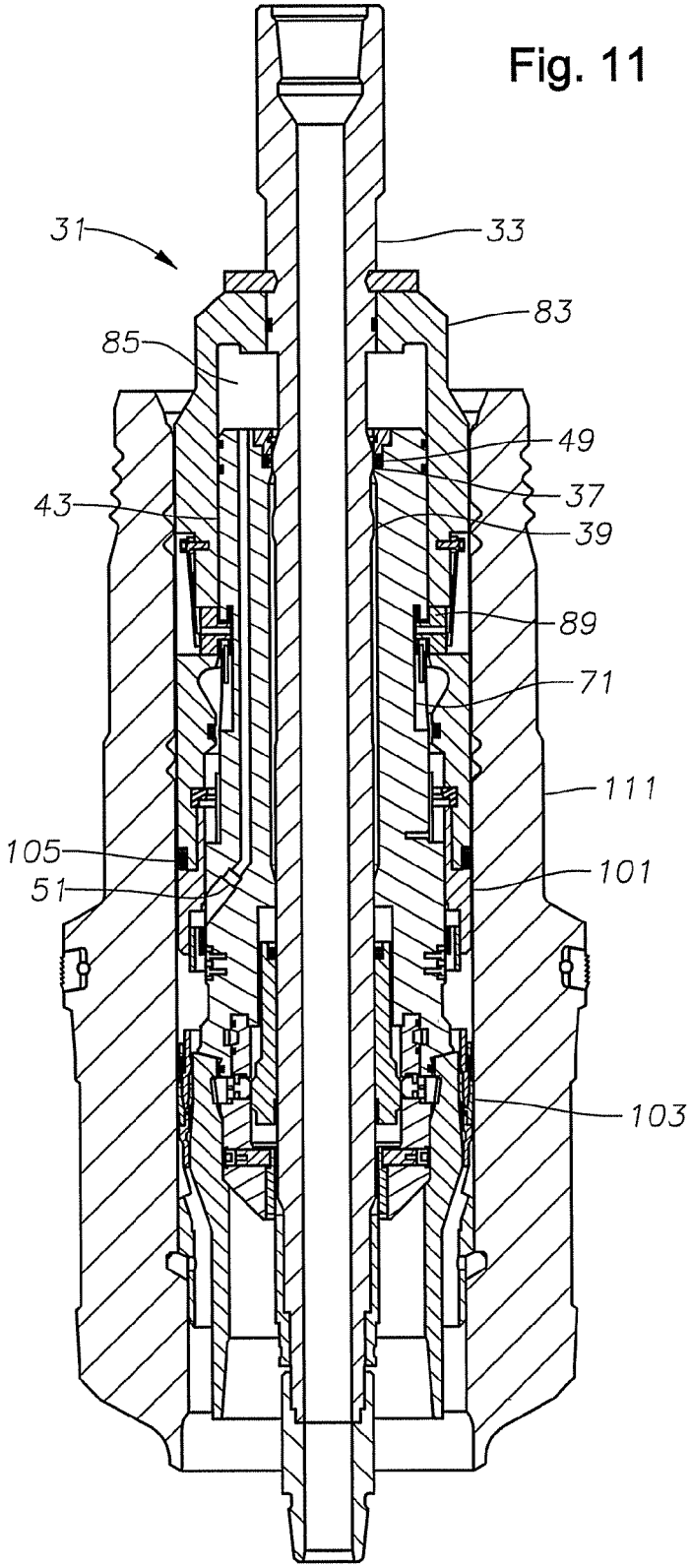
FIG. 11 is a sectional view of the running tool of FIG. 1 in the test position.
Figure 12:
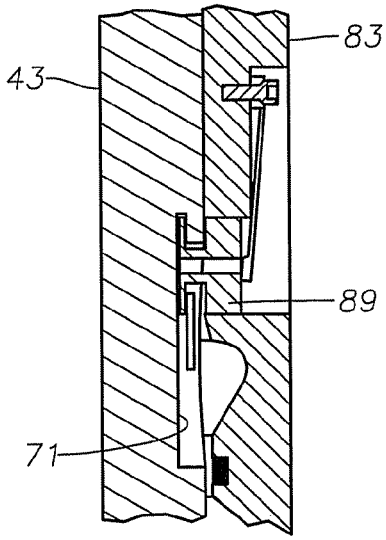
FIG. 12 is an enlarged view of the limit pin and test slot portions of the running tool of FIG. 11.
Figure 13:
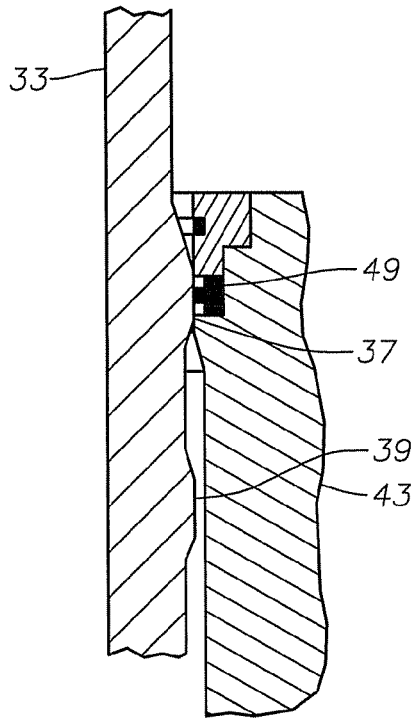
FIG. 13 is an enlarged view of the stem and inner body seal portions of the running tool of FIG. 11.

Referring to FIG. 11, once the piston 83 is driven downward and packoff seal 103 is set, the drill string (not shown) and subsequently stem 33 and piston 83 are pulled longitudinally upward relative to inner body 43 with sufficient force to release packoff seal 103 from setting sleeve 101. As the stem 33 and piston 83 move longitudinally upward relative to inner body 43, the weight is removed from elastomeric seal 105 and it moves radially inward, disengaging the inner surface of the wellhead housing 111, thereby permitting fluid flow past the seal 105. As piston 83 moves longitudinally upward relative to inner body 43, limit pin 89 travels upwards in slot 71 on the inner body 43 until limit pin 89 reaches the uppermost end of slot 71 reaching a "test" position (FIG. 12). As the stem 33 moves longitudinally upward relative to inner body 43, the seal 49 on the inner surface of inner body 43 and raised profiles 37, 39 on the outer surface of stem 33 also move relative to one another. Seal 49 engages the first raised profile 37 on the outer surface of stem 33 (FIG. 13). This position prohibits fluid communication from the exterior of inner body 43 to the interior of the inner body 43, through fluid port 51 and chamber 85. With the limit pin 89 in the uppermost end of test slot 71 on the inner body 43, fluid pressure is applied down the annulus to the upper side of packoff seal 103, thereby testing it.

Figure 14:
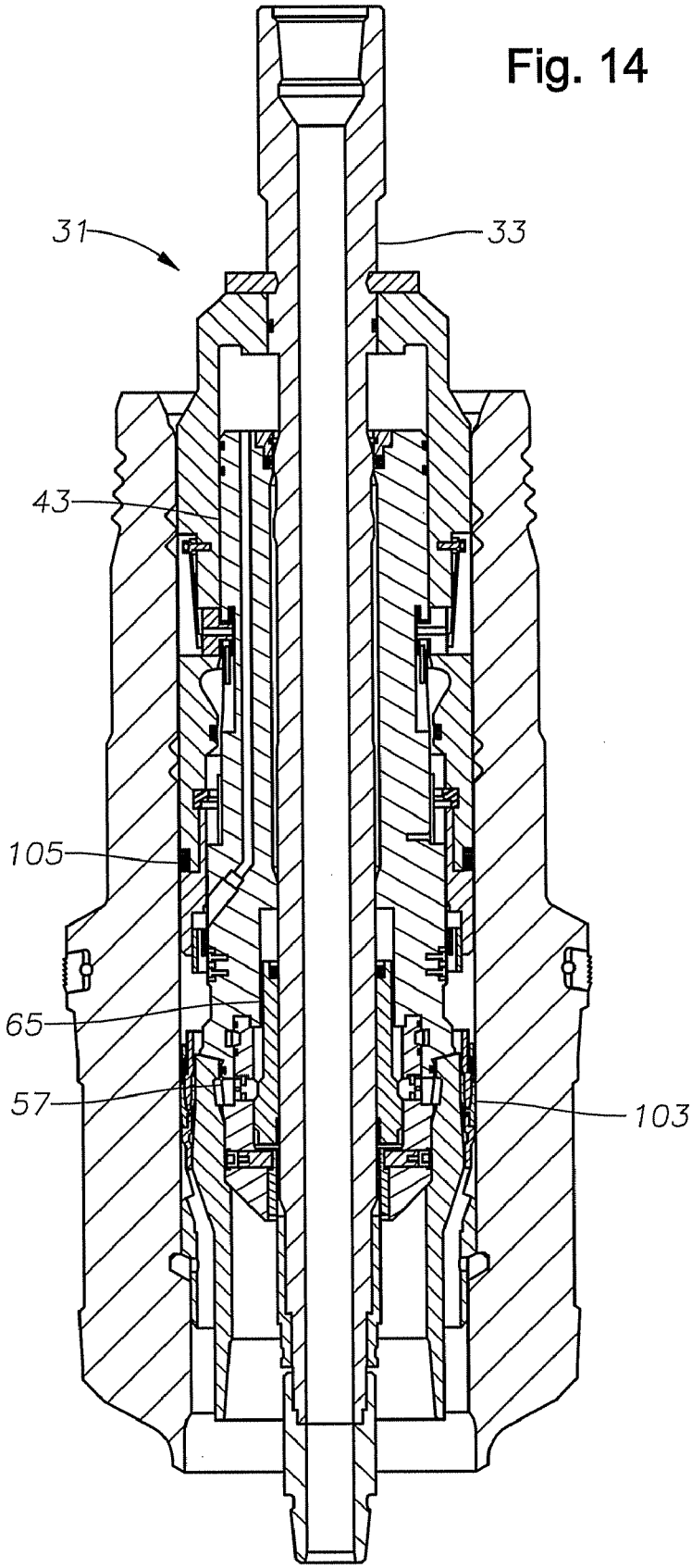
FIG. 14 is a sectional view of the running tool of FIG. 1 in the unlocked position with the engagement element disengaged.

Referring to FIG. 14, once the packoff seal 103 has been tested, the stem 33 is then rotated four additional revolutions in the same direction. As the stem 33 is rotated relative to the inner body 43, cam 65 moves longitudinally downward relative to inner body 43. As cam 65 moves longitudinally downward relative to inner body 43, engaging element 57 is no longer forced outward by cam 65, and moves radially inward, thereby unlocking the running tool 31 from the casing hanger 61. Running tool 31 may then be removed from the wellbore and returned to the surface.

Figure 15:
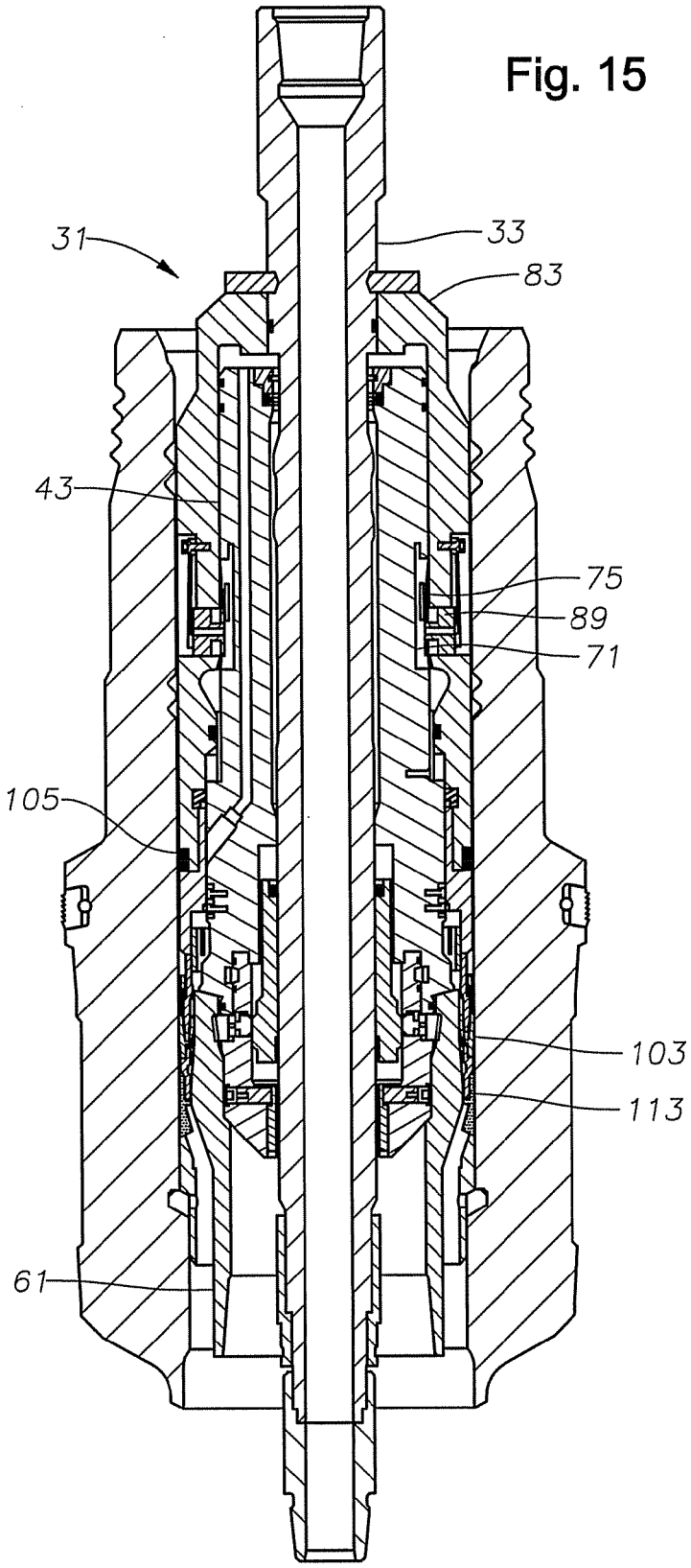
FIG. 15 is a sectional view of the running tool of FIG. 1 in a partially set position.
Figure 16:
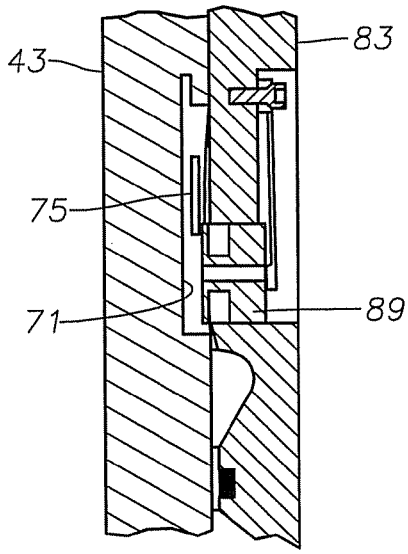
FIG. 16 is an enlarged view of the limit pin and test slot portions of the running tool of FIG. 15.
Figure 17:
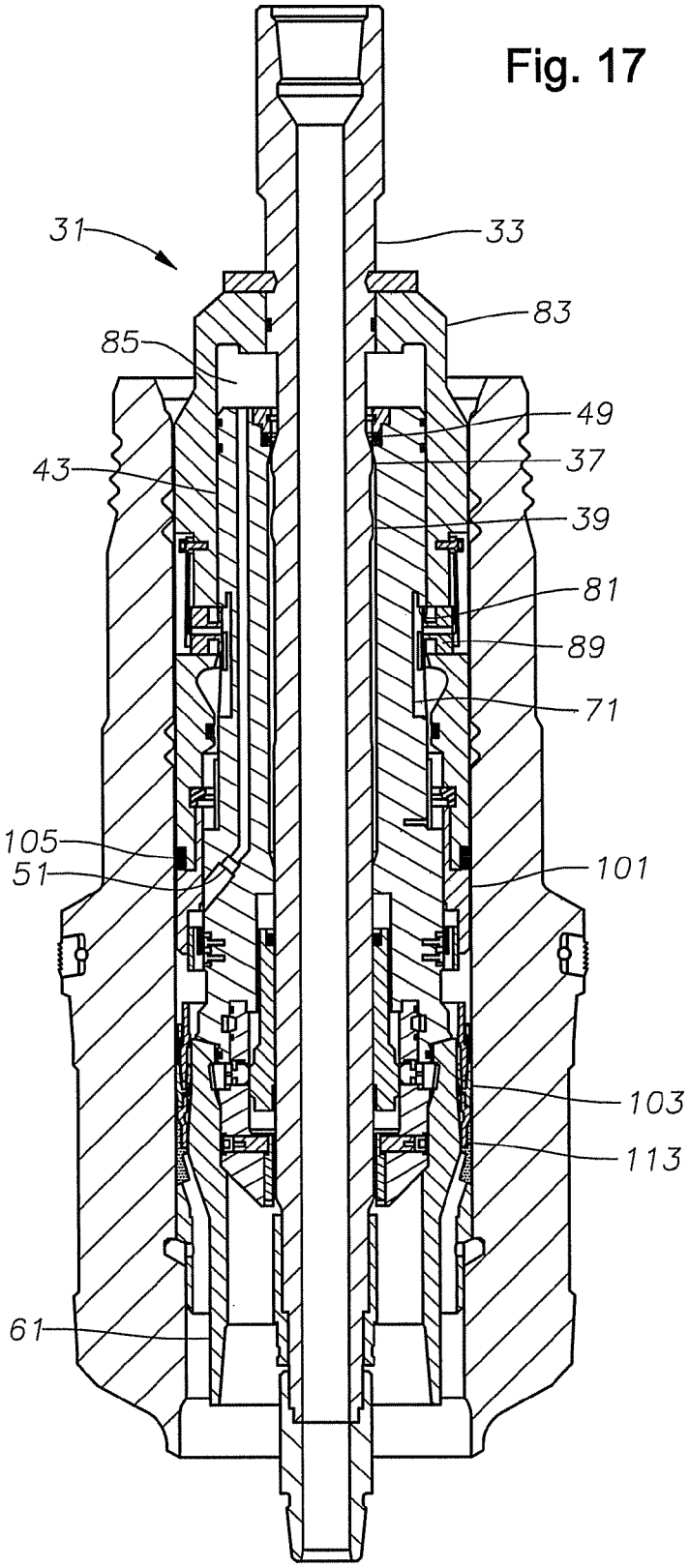
FIG. 17 is a sectional view of the running tool of FIG. 1 in a safe position.

Referring to FIGS. 15 through 19, if packoff seal 103 is not properly set, running tool 31 prevents the packoff 103 from being tested. For example, if debris and/or trash 113 is present in the shoulder area of hanger 61, seal 103 may not properly set. As illustrated in FIG. 15, pressure has been applied above elastomeric seal 105 to set packoff seal 103, however, stem 33 and piston 83 did not move sufficiently longitudinally downward relative to inner body 43 to set packoff seal 103. As illustrated in FIG. 17, although limit pin 89 has moved radially inward and partially entered slot 71, restrictor 75 has prevented limit pin 89 from fully entering test slot 71. Since piston 83 did not move sufficiently longitudinally downward relative to inner body 43 to set packoff seal 103, limit pin 89 also did not move sufficiently longitudinally downward relative to inner body 43 to fully enter test slot 71.

Figure 18:
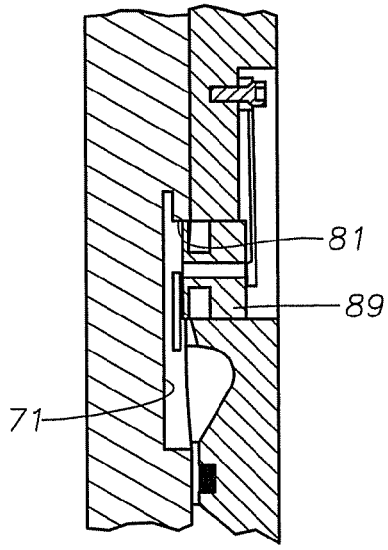
FIG. 18 is an enlarged view of the limit pin and test slot portions of the running tool of FIG. 17.

Referring to FIG. 17, as discussed above, the running and testing sequence is continued and the stem 33 and piston 83 are pulled longitudinally upward relative to the inner body 43 with sufficient force to release the packoff seal 103 from the setting sleeve 101. As the stem 33 and piston 83 move longitudinally upward relative to inner body 43, the weight is removed from elastomeric seal 105 and it moves radially inward, disengaging the inner surface of the wellhead housing 111, thereby permitting fluid flow past the seal 105. As piston 83 moves longitudinally upward relative to inner body 43, limit pin 89 travels upwards in slot 71, restricted from moving radially inward by restrictor 75 on the inner body 43. The limit pin 89 reaches an upper end of slot 71 where it contacts downward facing shoulder 81 which prevents further upward movement of limit pin 89 (FIG. 18). Because the limit pin did not fully enter slot 71, limit pin 89 can not reach the uppermost end of slot 71 (FIG. 12). This position is considered a "safe" position that will prevent a true packoff seal 103 test. (FIG. 18).

Figure 19:
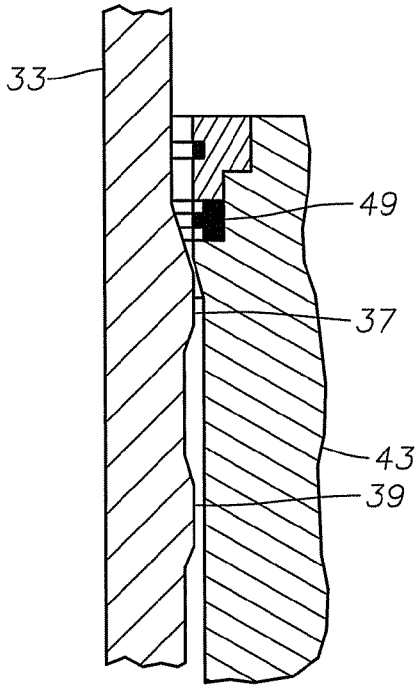
FIG. 19 is an enlarged view of the stem and inner body seal portions of the running tool of FIG. 17.

As the stem 33 moves longitudinally upward relative to inner body 43, the seal 49 on the inner surface of inner body 43 and raised profiles 37, 39 on the outer surface of stem 33 also move relative to one another. Because the limit pin did not fully enter slot 71, stem 33 and piston 83 can not move sufficiently longitudinally upward relative to inner body 43 for seal 49 to engage the first raised profile 37 on the outer surface of stem 33 (FIG. 19). As a result, fluid may communicate from the exterior of inner body 43 through fluid port 51, into chamber 85, through the space between the interior of the inner body 43 and stem 33, and back up the drill string.

With the limit pin 89 in the "safe" position, fluid pressure is applied down the annulus. However, before the pressure can build up on the upper side of packoff seal 103, the fluid travels through fluid port 51 in inner body 43 and into chamber 85. The fluid then travels through the unsealed passage between inner body 43 and stem 33 before traveling through the remainder of running tool 31 and back up the string of drill pipe. Returns on the surface end of the string of drill pipe (not shown) indicate that the limit pin 89 is in the "safe" position, and the stroke of piston 83 was not sufficient to set packoff seal 103.

The technique has significant advantages. The running tool combines the limit pin and the test slot with the raised profile portion of the stem and the seal on the inner body to ensure that the packoff is not pressure tested unless the proper setting stroke is made by the running tool. The fluid port allows fluid to travel from the exterior of the running tool through the components and back up the drill string if the packoff has not been properly set, reducing the chance of pressure leaking past the packoff and collapsing the casing.

While the technique has been shown in only one of its forms, it should be apparent to those skilled in the art that it is not so limited but is susceptible to various changes without departing from the scope of the technique.

The invention claimed is:

1. A running tool for setting a packoff of a well pipe hanger, the running tool comprising:

an elongated stem having an axial passage;

an inner body substantially surrounding and connected to the stem such that rotation of the stem causes the stem to translate axially relative to the inner body;

a piston connected to the stem such that the piston and the stem rotate and translate in unison, the piston substantially surrounding portions of the stem and the inner body;

at least one slot positioned in and extending axially along a length of the outer surface of the inner body, the at least one slot extending radially inward through the outer surface of the inner body; and at least one pin carried by the piston and adapted to move radially inward and engage the at least one slot when the piston moves axially relative to the inner body to a set position to thereby set a packoff.

2. The running tool according to claim 1, wherein the running tool further comprises:

a raised profile on an exterior portion of the stem; and a seal connected to the inner body and positioned between the stem and the inner body such that it sealingly engages the raised profile portion of the stem when the piston and stem move axially relative to the inner body to a test position to thereby pressure test the packoff.

3. The running tool of claim 2, wherein the running tool further comprises:

a chamber defined by the outer peripheries of the exterior surface of the stem, the interior surface of the piston, and an upper surface of the inner body; and a port extending from the outer surface of the inner body and into the chamber such that fluid can communicate from the exterior of the running tool through the port, into the chamber, and between the stem and inner body and back up the stem when the piston moves axially relative to the inner body to a safe position to thereby disengage the seal and the raised profile portion of the stem.

4. The running to tool of claim 1, wherein the running tool further comprises:

threads on an inner portion of the inner body;

a cam positioned between the stem and the inner body, the cam connected to the stem such that the two rotate in unison but translate independent from one another, the cam having threads on its outer surface and a downward facing shoulder positioned adjacent thereto, the cam being threaded to the inner body; and an engagement element, carried by the inner body and adapted to be engaged with a hanger, the axial movement of the stem relative to the inner body causing the shoulder to contact the engagement element and move it radially outward and in engagement with the hanger to releasably secure the running tool to the hanger.

5. The running tool according to claim 1, wherein the slot has a greater width at a lower portion thereof than at an upper portion thereof to permit the pin to fully engage the slot when the piston moves axially relative to the inner body to the set position.

6. A method of setting and testing a packoff of a well pipe hanger, the method comprising:

(a) providing a running tool with an elongated stem having an axial passage; an inner body substantially surrounding and connected to the stem such that rotation of the stem causes the stem to translate axially relative to the inner body; a piston substantially surrounding portions of the stem and the inner body and connected to the stem such that the two move in unison, the piston axially moveable relative to the inner body; a slot located in and extending through the inner body; and a pin connected to the piston;

(b) mounting a packoff to a running tool;

(c) rotating the stem relative to the inner body to a run-in position, thereby securely engaging the running tool with the well pipe hanger;

(d) running the tool and a well pipe hanger on a string of conduit into a subsea wellhead;

(e) applying fluid pressure to the annular area surrounding the string of conduit to set the packoff; and (f) moving the tool toward a test position and applying fluid pressure to the annular area surrounding the string of conduit, in response to the pin of the tool failing to fully engage the slot of the tool, thereby failing to reach the test position, directing fluid in the annular area surrounding the string of conduit to flow up the conduit.

7. The method of claim 6, wherein step (d) further comprises:

rotating the stem relative to the inner body to a pre-land position, thereby releasing the piston and the stem for axial movement relative to the inner body; and lowering the stem and the piston axially relative to the inner body to a landing position.

8. The method of claim 7, wherein step (e) further comprises:

moving the piston and the stem axially downward relative to the inner body and at least partially engaging the pin in the slot; and wherein step (d) further comprises:

moving the piston and the stem axially upward relative to the inner body.

9. The method of claim 7, wherein movement from the run-in position to the pre-land position is accomplished by rotating the stem in the same direction relative to the inner body.

10. The method of claim 7, wherein the stem moves axially downward relative to the inner body when the stem is rotated form the run-in position to the pre-land position.

11. The method of claim 8, the method further comprising:

providing the running tool with a raised profile on an exterior portion of the stem; a seal element on the inner surface of the inner body; a fluid port extending from an outer surface of the inner body to an upper surface thereof; and wherein step (d) further comprises:

if the tool moves to the test position, engaging the seal element with the raised profile on the stem, thereby sealing between the inner body and the stem, preventing fluid from communicating from the annular area, through the fluid port, and back up the conduit.

12. A method of setting and testing a casing hanger packoff, the method comprising:

(a) providing a running tool with an elongated stem having an axial passage and a raised profile on its outer surface; an inner body surrounding and connected to the stem such that rotation of the stem causes the stem to translate axially relative to the inner body; a piston substantially surrounding portions of the stem and the inner body and connected to the stem such that the two move in unison, downwardly moveable relative to the inner body; a slot located in and extending through the inner body; a pin connected to the piston; a chamber defined by the outer boundaries of the exterior surface of the stem, the interior surface of the piston, and an upper surface of the inner body; a port located in the exterior surface of the inner body and extending through it and into the chamber; a seal element connected to the inner surface of the inner body; and (b) rotating the stem relative to the inner body to a run-in position, thereby securely engaging the running tool with a hanger;

(c) running the tool and the hanger into a subsea wellhead;

(d) rotating the stem relative to the inner body to thereby release the stem and piston for axial movement relative to the inner body;

(e) lowering the stem and the piston axially relative to the inner body to a landing position;

(f) applying fluid pressure to an annular area surrounding the piston to further move the piston and stem axially downward relative to the inner body, thereby at least partially engaging the pin in the slot;

(g) raising the stem and piston axially relative to the inner body; and (h) applying fluid pressure to the annular area above the packoff.

13. The method of claim 12, further comprising:

providing a running tool with a raised profile on the outer surface of the stem; a chamber defined by the outer boundaries of the exterior surface of the stem, the interior surface of the piston, and an upper surface of the inner body; a fluid port located in the exterior surface of the inner body and extending through it and into the chamber; a seal element connected to the inner surface of the inner body; and wherein step (f) further comprises:

fully engaging the pin in the slot, thereby moving the pin to a set position within the slot; and wherein step (g) further comprises:

moving the pin to a test position within the slot; and engaging the seal element with the raised profile on the stem, thereby sealing between the inner body and the stem, preventing fluid from communicating from the annular area, through the fluid port, and back up the axial passage; and wherein step (h) further comprises:

testing the packoff.

14. The method of claim 12, further comprising:

providing a running tool with a chamber defined by the outer boundaries of the exterior surface of the stem, the interior surface of the piston, and an upper surface of the inner body; a fluid port located in the exterior surface of the inner body and extending through it and into the chamber; and wherein step (f) further comprises:

partially engaging the pin in the slot, thereby moving the pin to a safe position within the slot; and wherein step (g) further comprises:

moving the pin upwards within the slot, maintaining the safe position; and wherein step (h) further comprises:

communicating fluid pressure from the annular area, through the fluid port, and back up the axial passage, thereby preventing the packoff from being tested.

15. The method of claim 12, further comprising after step (h):

rotating the stem relative to the inner body in the same direction to a release position, thereby releasing the running tool from the casing hanger.

16. A running tool for setting an annular seal having an energizing ring in a subsea well, the running tool comprising:

a member adapted to position the annular inner seal within the subsea well;

a piston adapted to drive the energizing ring to set the annular seal in the subsea well; and a safety system adapted to prevent a test pressure from being applied to the annular seal after the annular seal has been set by the energizing ring unless the energizing ring is located at a desired position relative to the annular seal.

17. The running tool according to claim 16, wherein the safety system is adapted to vent a region above the annular seal unless the energizing ring is located at the desired position relative to the annular seal.

18. The running tool according to claim 16, wherein the safety system is adapted to prevent the piston from being moved to a test position that enables the test pressure to be applied to the annular seal unless the energizing ring is located at the desired position relative to the annular seal.

* * * * *